US011493178B2

(12) United States Patent
vonHapke

(10) Patent No.: US 11,493,178 B2
(45) Date of Patent: Nov. 8, 2022

(54) MODULAR TREE LIGHTS

(71) Applicant: Nancy vonHapke, Toronto (CA)

(72) Inventor: Nancy vonHapke, Toronto (CA)

( * ) Notice: Subject to any disclaimer, the term of this patent is extended or adjusted under 35 U.S.C. 154(b) by 0 days.

(21) Appl. No.: 17/534,860

(22) Filed: Nov. 24, 2021

(65) Prior Publication Data

US 2022/0170598 A1 Jun. 2, 2022

Related U.S. Application Data

(60) Provisional application No. 63/118,778, filed on Nov. 27, 2020.

(51) Int. Cl.

| | |
|---|---|
| ***F21S 4/10*** | (2016.01) |
| ***F21V 21/002*** | (2006.01) |
| ***F21V 23/06*** | (2006.01) |
| ***F21V 23/02*** | (2006.01) |
| *F21W 121/04* | (2006.01) |

(52) U.S. Cl.

CPC ..... *F21S 4/10* (2016.01); *F21V 21/002* (2013.01); *F21V 23/06* (2013.01); *F21V 23/02* (2013.01); *F21W 2121/04* (2013.01)

(58) Field of Classification Search

CPC . F21S 4/10; F21V 23/06; F21V 23/02; F21W 2121/04

See application file for complete search history.

(56) References Cited

U.S. PATENT DOCUMENTS

| | | | | |
|---|---|---|---|---|
| 3,723,723 | A | 3/1973 | Lerner | |
| 3,770,951 | A | 11/1973 | Corelli et al. | |
| 4,870,547 | A | 9/1989 | Crucefix | |
| 5,422,801 | A * | 6/1995 | Sangalli, Jr. | F21S 4/10 362/249.19 |
| 10,617,248 | B2 * | 4/2020 | Hale | F21V 23/002 |

* cited by examiner

*Primary Examiner* — Anabel Ton

(57) ABSTRACT

Some embodiments of the present disclosure provide a tree lighting system. The tree lighting system includes a source of direct current electrical power, a power connector plug connected to the source of direct current electrical power, a strand of parallel-connected lamp elements, the strand connected to a lighting connector plug, and a body. The body includes a power connector jack configured to mate with the power connector plug to receive the electrical power, a lighting connector jack configured for providing the electrical power received at the power connector jack to the lighting connector and an electricity conductor connecting the power connector jack to the lighting connector jack.

8 Claims, 11 Drawing Sheets

MODULAR TREE LIGHTS

CROSS-REFERENCE TO RELATED APPLICATION

This application claims the benefit of U.S. Provisional Patent Application Ser. No. 63/118,778 filed on Nov. 27, 2020. The contents of the aforementioned application are incorporated by reference herein.

TECHNICAL FIELD

The present disclosure relates generally to tree lighting and, in particular embodiments, to modular tree lights.

BACKGROUND

Christmas tree lighting assemblies have been known to be configured for wrapping around a tree. Wrapping is known to cause problems in that a backside of the tree is not always easily accessible. This problem, and other problems with conventional tree lighting systems have led people to develop alternative Christmas tree lighting assemblies. Alternative Christmas tree lighting assemblies have been known to provide a plurality of discrete dependent strands of series-connected lamp elements extending downwardly from a collar mounted about the top of a Christmas tree. Known alternative tree lighting assemblies are disclosed in U.S. Pat. Nos. 3,770,951, 3,723,723 and 4,870,547.

SUMMARY

According to an aspect of the present disclosure, there is provided a ring assembly. The ring assembly includes a body. The body includes a power connector jack configured to mate with a power connector plug, the power connector plug connected to a source of direct current electrical power, a lighting connector jack configured for providing the electrical power received at the power connector jack to a strand of parallel-connected lamp elements, the strand connected to a lighting connector plug configured to mate with the lighting connector jack to receive the electrical power and an electricity conductor connecting the power connector jack to the lighting connector jack.

According to an aspect of the present disclosure, there is provided a tree lighting system. The tree lighting system includes a source of direct current electrical power, a power connector plug connected to the source of direct current electrical power, a strand of parallel-connected lamp elements, the strand connected to a lighting connector plug and a body. The body includes a power connector jack configured to mate with the power connector plug to receive the electrical power, a lighting connector jack configured for providing the electrical power received at the power connector jack to the lighting connector and an electricity conductor connecting the power connector jack to the lighting connector jack.

BRIEF DESCRIPTION OF THE DRAWINGS

For a more complete understanding of the present embodiments, and the advantages thereof, reference is now made, by way of example, to the following descriptions taken in conjunction with the accompanying drawings, in which.

DETAILED DESCRIPTION OF ILLUSTRATIVE EMBODIMENTS

For illustrative purposes, specific example embodiments will now be explained in greater detail in conjunction with the figures.

The embodiments set forth herein represent information sufficient to practice the claimed subject matter and illustrate ways of practicing such subject matter. Upon reading the following description in light of the accompanying figures, those of skill in the art will understand the concepts of the claimed subject matter and will recognize applications of these concepts not particularly addressed herein. It should be understood that these concepts and applications fall within the scope of the disclosure and the accompanying claims.

Known tree lighting assemblies generally feature hard-wired light strands. That is, light strands are permanently connected to the collar that receives and distributes electricity for the lights. Furthermore, the hard-wired light strands typically have homogeneous lights, that is, lights that are all of the same size, wattage and color. Notably, when the lights are connected in series, an electrical problem, such as a short, with one strand renders the entire system dangerous. Additionally, it seems that known tree lighting assemblies are generally installed at the top of a tree and, as such, require a long connection to an electrical power receptacle.

In overview, aspects of the present application relate to a ring assembly that may be used as part of a modular tree lighting system. The ring assembly has a plurality of connector jacks and internal electrical conductors connecting the connector jacks. The connector jacks include a primary power connector jack that receives electrical power and a lighting connector jack that provides the electrical power to, for example, a parallel-connected strand of lights. The ring assembly may also include a secondary power connector jack that may be a route by which the electrical power is provided to, for example, a further, similarly constructed ring assembly. Conveniently, the ring assembly may be considered to be a single module in a modular tree lighting system. Any number of modules may be used and the strands of lights that are connected to each module need not be homogeneous.

Figure 1:
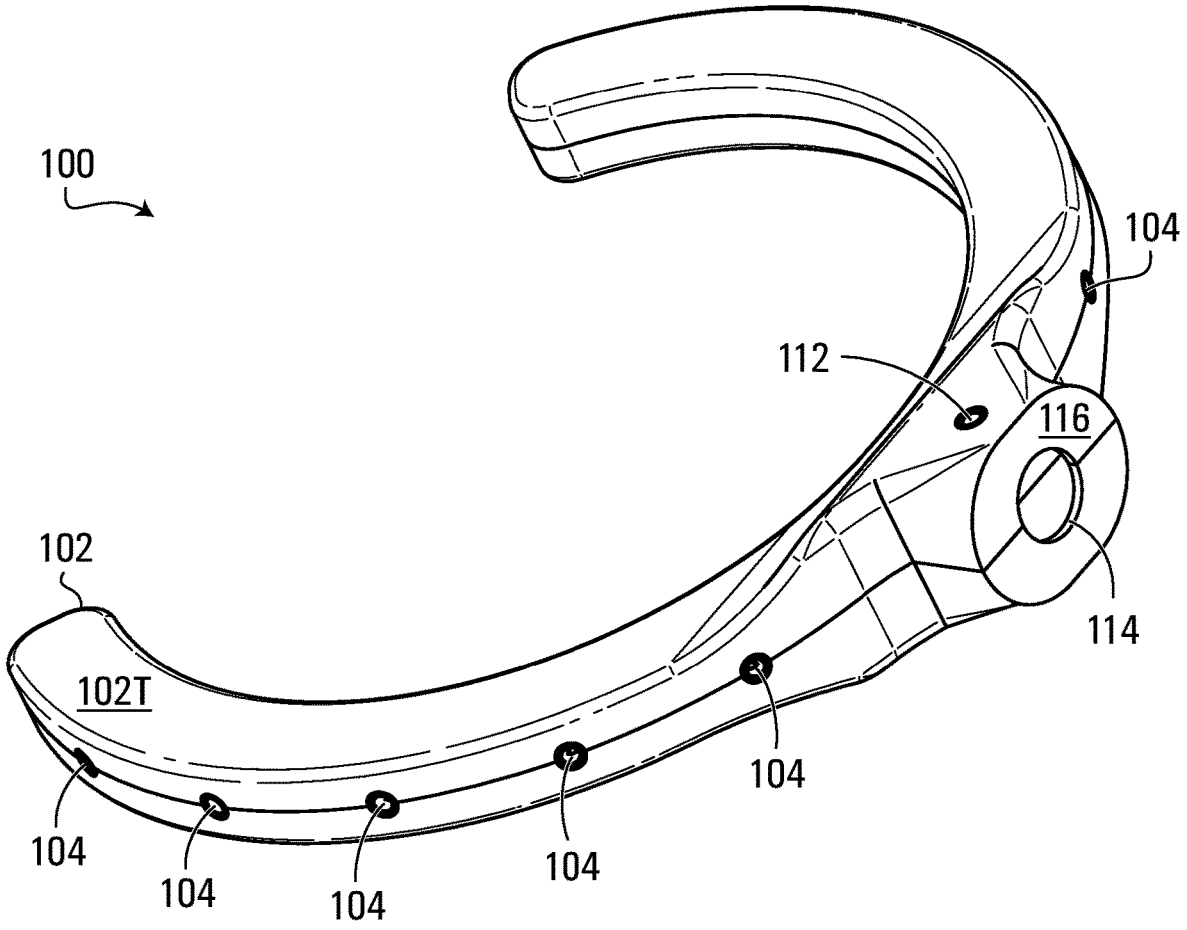
FIG. 1 illustrates, in a top-right perspective view, a ring assembly having a body according to aspects of the present application.

FIG. 1 illustrates, in a top-right perspective view, a ring assembly 100 according to aspects of the present application. The ring assembly 100 may be seen to have a body 102 that defines a plurality of lighting connector apertures 104. The body 102 may be formed by fastening together a top body part 102T and a bottom body part 1026. The parts 102T, 1026 of the body 102 may be seen to, when fastened together, define the plurality of lighting connector apertures 104. Internal to the body 102, and accessible via the plurality of lighting connector apertures 104, are a plurality of lighting connector jacks (not shown in FIG. 1), with each lighting connector aperture 104 corresponding to a lighting connector jack.

The body 102 illustrated in FIG. 1 is C-shaped, with an opening on one side. It should be clear that the body 102 may be manufactured in any one of many other shapes while still retaining a functional ability to be installed among the branches of a tree such that, typically, the body 102 incompletely surrounds the trunk of the tree. There exist many options for the material from which to manufacture the body 102. Preferably a flexible rubber, or rubber-like, material may be selected. However, it should be clear that a hard material, such as molded plastic, may be an equally functional choice for the material for the body 102.

The body 102 is illustrated in FIG. 1 as including a neck portion 310 extending away from the side of the body 102 that has the opening. In the neck portion 310, the top part 102T of the body 102 defines a primary aperture 112. A primary power connector jack (not shown in FIG. 1) is accessible through the primary aperture 112 in the top part 102T in the neck portion 310.

The neck portion 310 defines a surface 116 that faces away from the opening side of the body 102. The surface 116 defines a recess 114.

Figure 2:
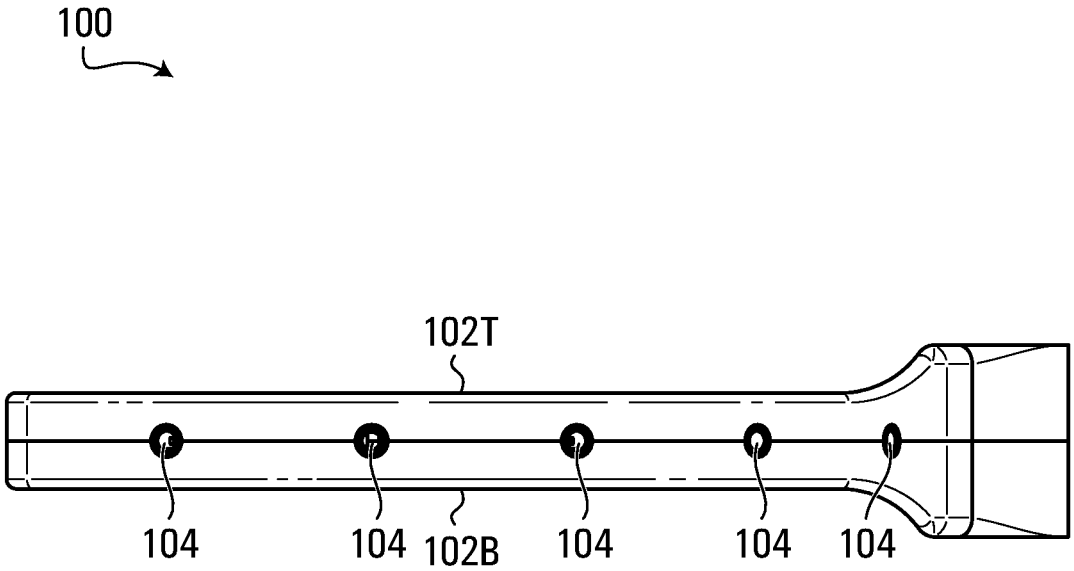
FIG. 2 illustrates, in side view, the ring assembly of FIG. 1, wherein the body has a top part and a bottom part according to aspects of the present application.

FIG. 2 illustrates, in side view, the ring assembly 100 of FIG. 1.

Figure 3:
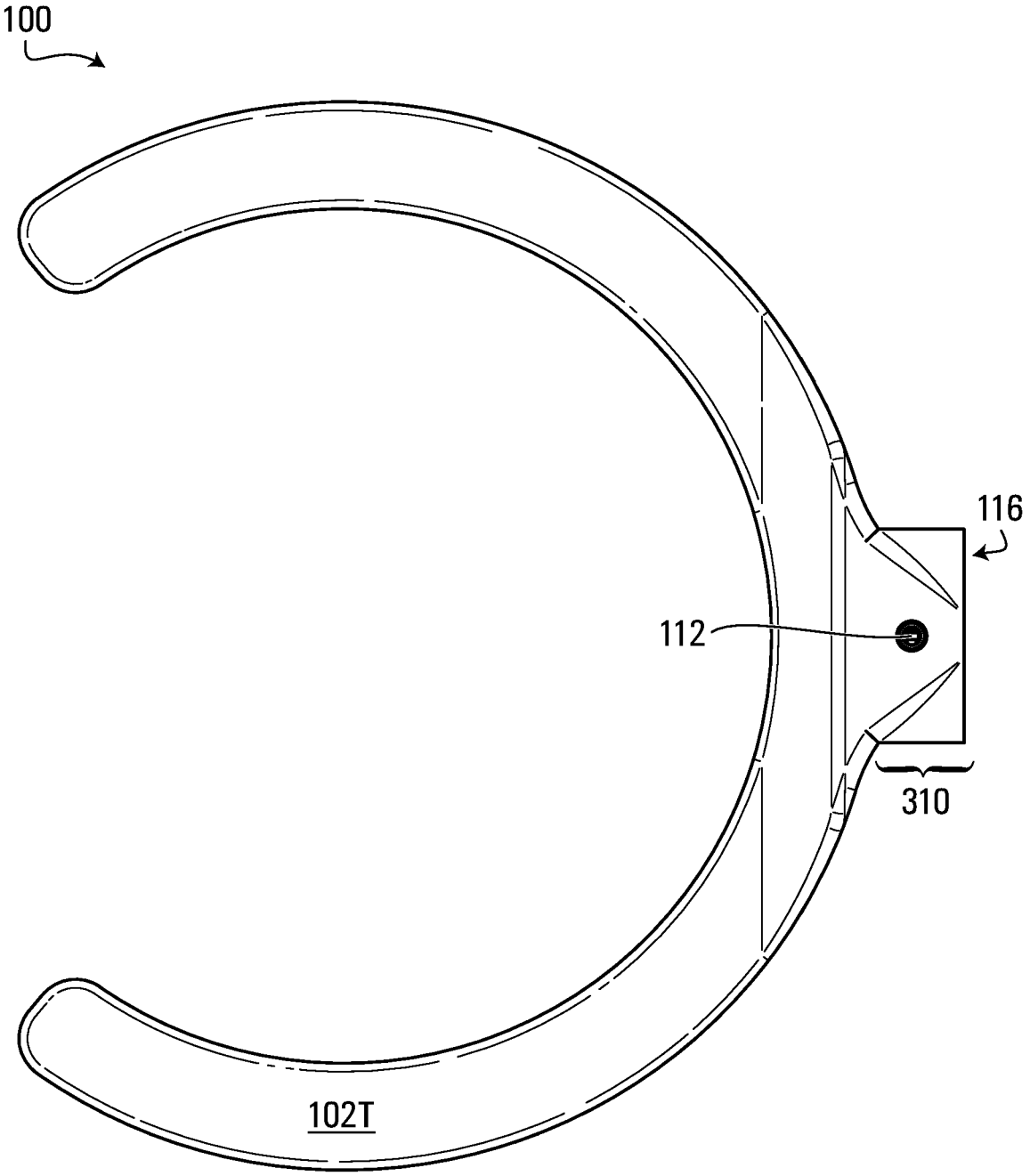
FIG. 3 illustrates, in top view, the top part of the body of the ring assembly of FIG. 1 according to aspects of the present application.

FIG. 3 illustrates, in top view, the top part 102T of the body 102 allowing a view of the neck portion 310.

Figure 4:
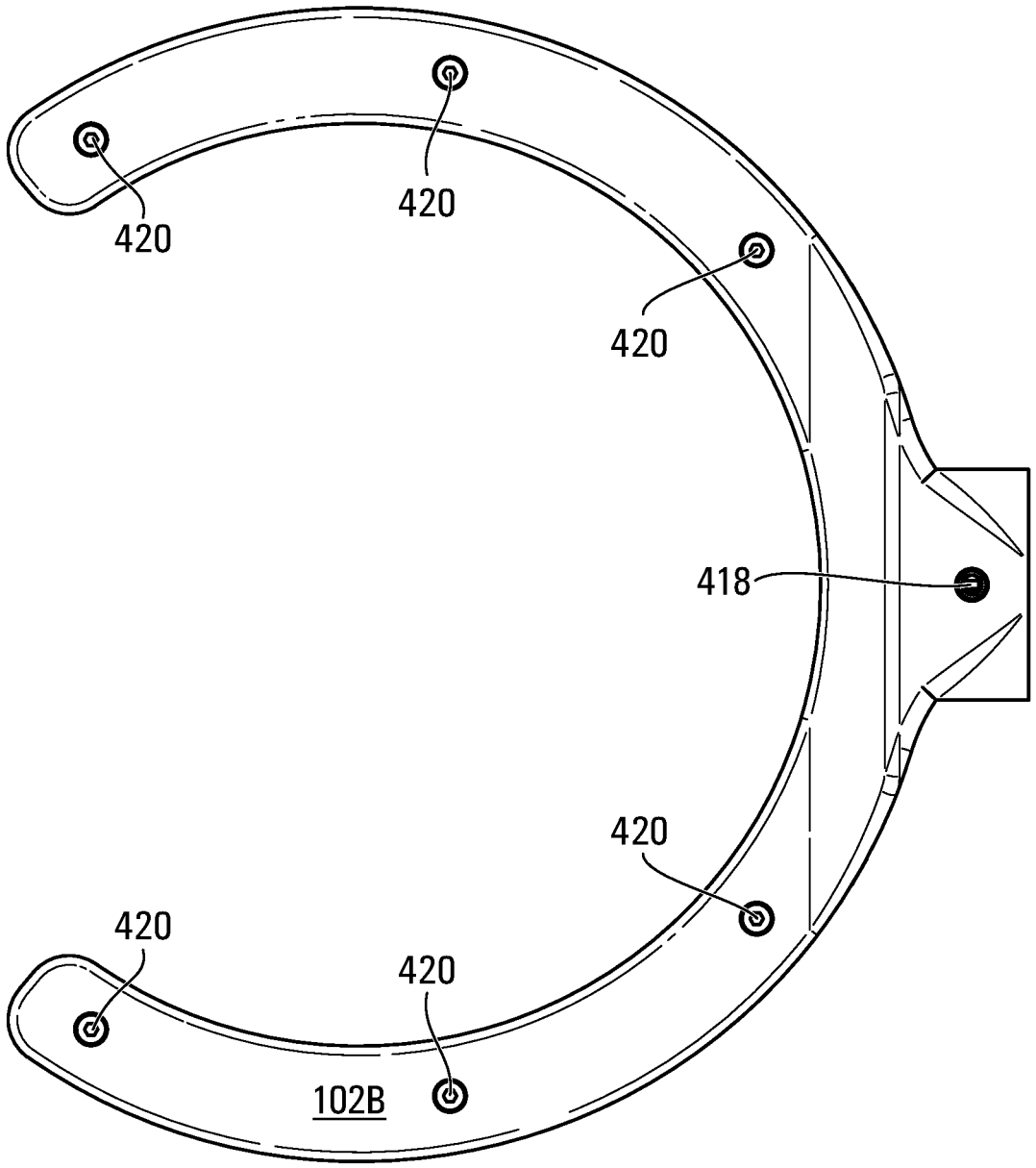
FIG. 4 illustrates, in bottom view, the bottom part of the body of the ring assembly of FIG. 1 according to aspects of the present application.

FIG. 4 illustrates, in bottom view, the bottom part 102B of the body 102. The view presented in FIG. 4 allows review of a plurality of fasteners 420 and a secondary aperture 418. Internal to the body 102, and accessible via the secondary aperture 418, is a corresponding secondary power connector jack (not shown in FIG. 4).

Figure 5:
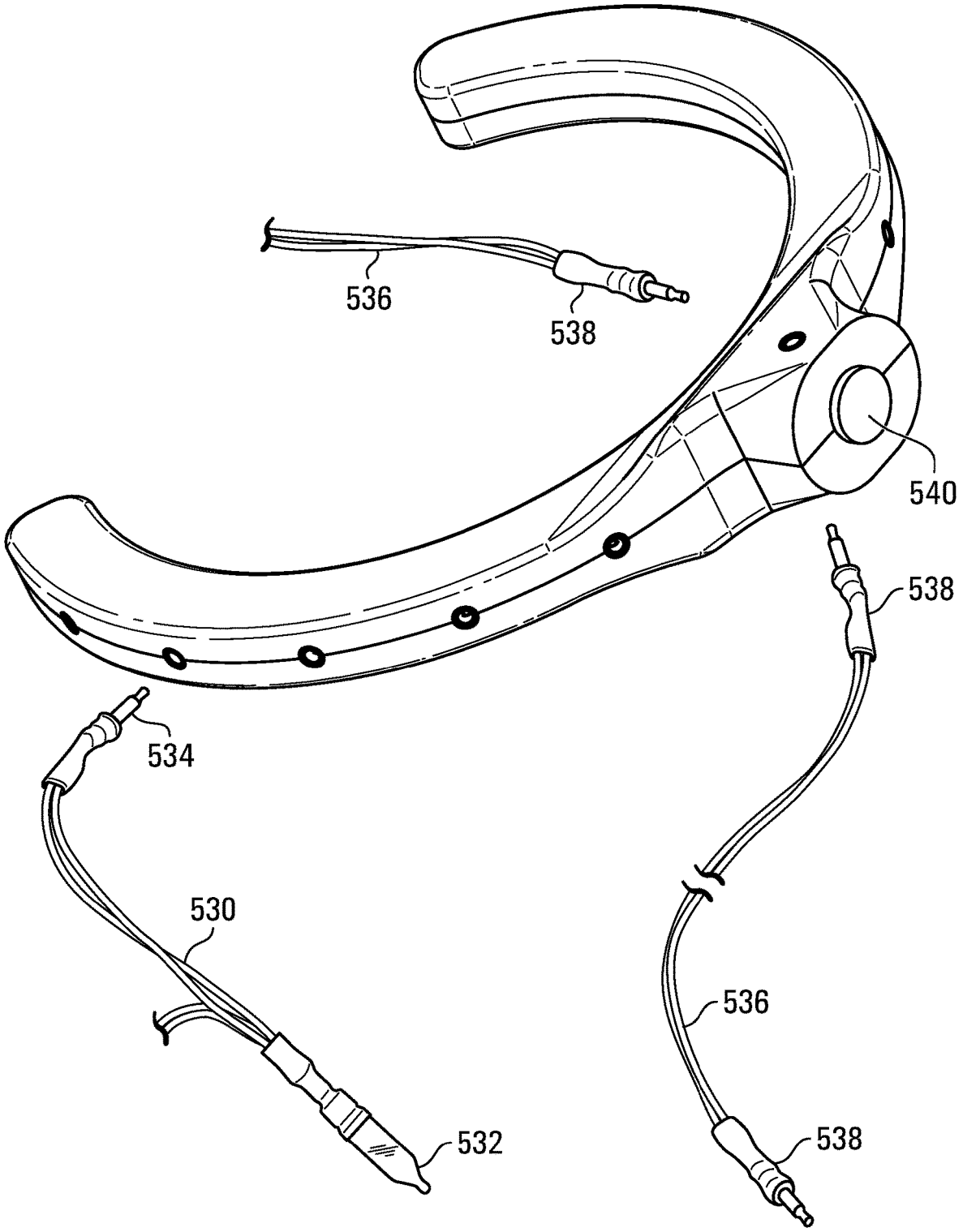
FIG. 5 illustrates a view of the ring assembly of FIG. 1 with the addition of a light strand, a light and a power cord with a power connector plug according to aspects of the present application.

FIG. 5 illustrates a view of the ring assembly 100 similar to the view in FIG. 1. FIG. 5 differs from FIG. 1 in that FIG. 5 includes a light strand 530. Only a single light 532 is illustrated. The light strand 530 is configured to connect to the ring assembly 100 via a lighting connector plug 534. FIG. 5 also illustrates a first power cord 536 with a power connector plug 538. A ring assembly magnet 540 with a size and shape corresponding to the recess 114 is illustrated in FIG. 5 as installed in the recess 114. A second power cord 536 is also illustrated in FIG. 5, with a power connector plug 538 on each end.

Figure 6:
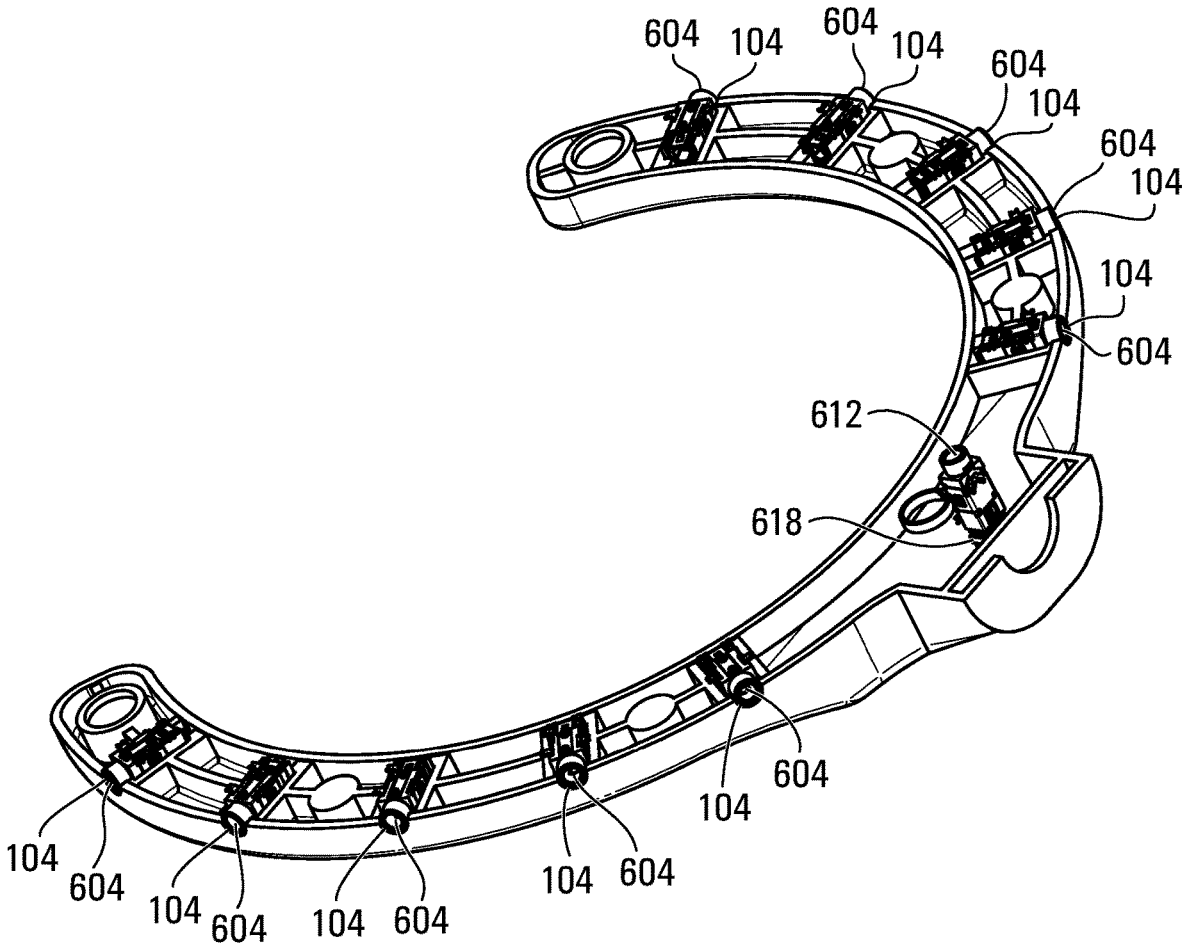
FIG. 6 illustrates a view of the ring assembly 100 with the top part of the body removed according to aspects of the present application.

FIG. 6 illustrates a view of the ring assembly 100 with the top part 102T of the body 102 removed. The interior of the bottom part 1026 of the body 102 is illustrated as including a plurality of lighting connector jacks 604 with positions that correspond to the plurality of apertures 104 defined by the fastening together of the top part 102T and the bottom part 1026 of the body 102. The interior of the bottom part 102B of the body 102 is also illustrated as including a primary power connector jack 612 corresponding to the primary aperture 112 in the top part 102T. The interior of the bottom part 1026 of the body 102 is further illustrated as including a secondary power connector jack 618 corresponding to the secondary aperture 418 in the bottom part 102B.

Figure 7:
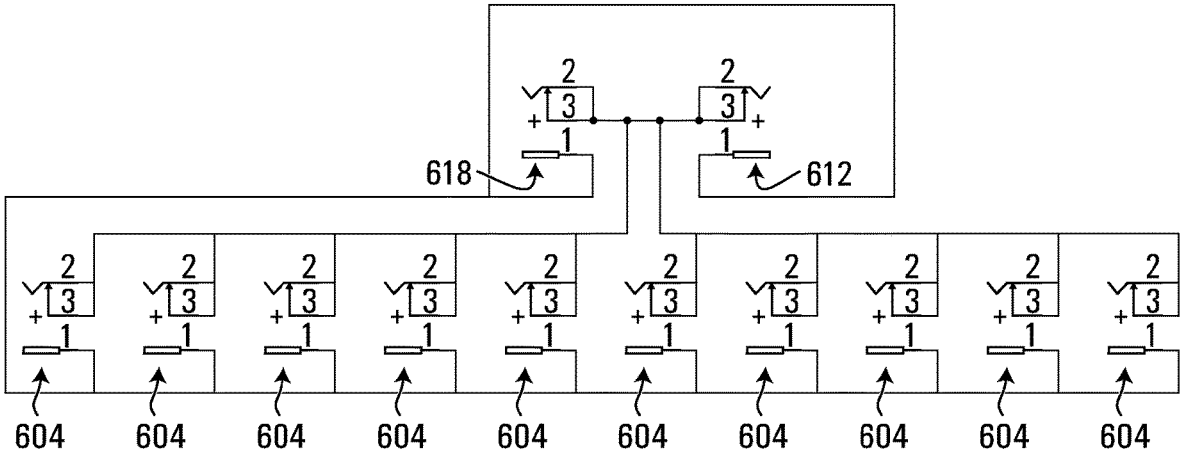
FIG. 7 illustrates an electrical circuit diagram for the electricity routed internally within the body of the ring assembly of FIG. 1, according to aspects of the present application.

FIG. 7 illustrates an electrical circuit diagram for the electricity routed internally within the body 102 of the ring assembly 100. The electrical circuit diagram of FIG. 7 illustrates connections between the primary power connector jack 612, the secondary power connector jack 618 and the plurality of lighting connector jacks 604.

Figure 8:
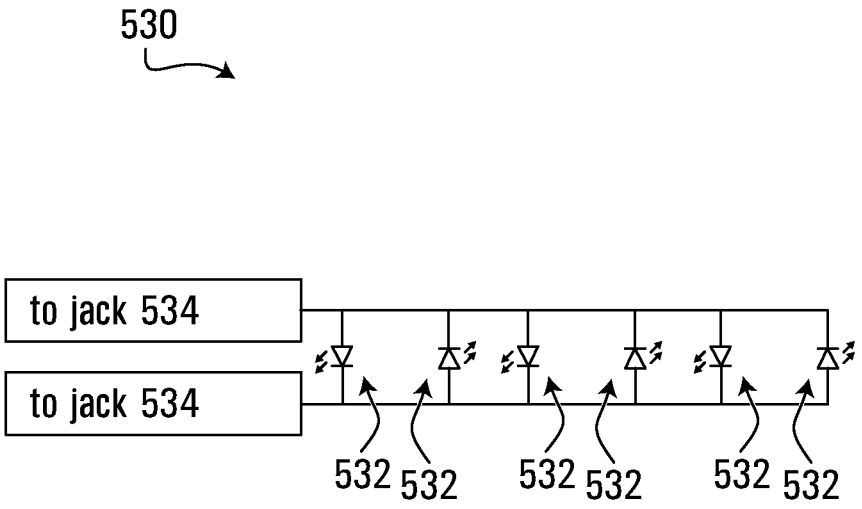
FIG. 8 illustrates an electrical circuit diagram for the light strand of FIG. 5, according to aspects of the present application.

FIG. 8 illustrates an electrical circuit diagram for the light strand 530. The single light 532 illustrated in FIG. 5 is represented along with five further lights 532, with all of the lights 532 connected in parallel. Notably, the lights 532 may be generically referenced as lamp elements and may be implemented as incandescent lights or light emitting diodes (LEDs).

In operation, as few as one and as many as ten light strands 530 may be connected to the ring assembly 100 by insertion of the respective lighting connector plugs 534 through a selected aperture 104 and into a corresponding lighting connector jacks 604. The power connector plug 538 at one end of the power cord 536 may be inserted through the primary aperture 112 and into the primary power connector jack 612.

Figure 9:
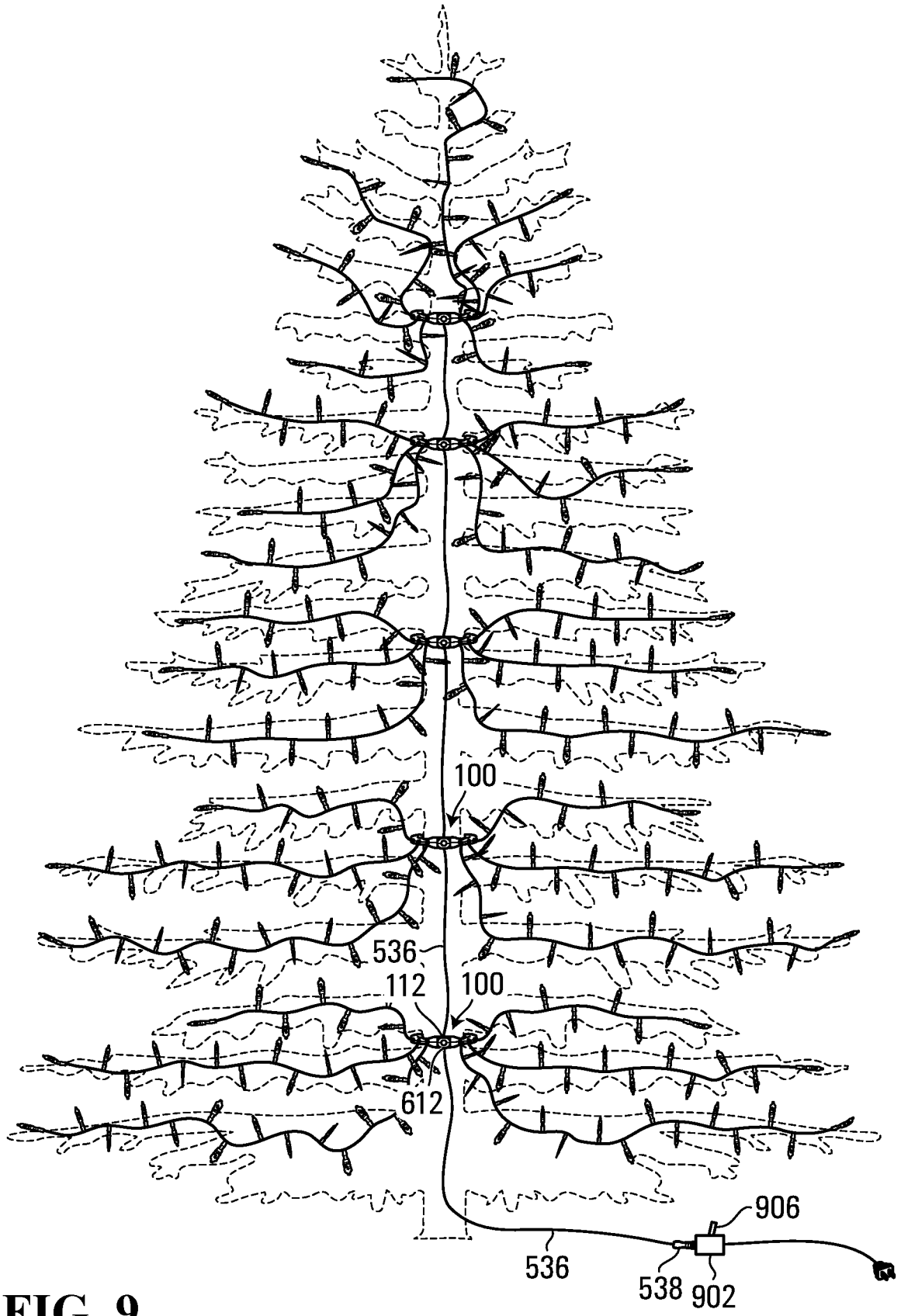
FIG. 9 illustrates a tree on which is installed a modular tree light system including multiple instances of the ring assembly of FIG. 1, according to aspects of the present application.

Once the power connector plug 538 has been plugged into the primary power connector jack 612, the ring assembly 100 may be installed on a tree, as illustrated in FIG. 9. The installation may involve placing the ring assembly 100 such that the trunk of the tree is mostly surrounded by the C-shaped body 102. The ring assembly 100 may then rest upon branches extending away from the trunk. The light strands 530 may fan out and also rest upon branches extending away from the trunk. The end of the power cord 536 that is opposite to the end that is connected to the ring assembly 100 may be connected to a transformer 902. The transformer 902 may include an on/off switch 906 and may be plugged into to an electrical power receptacle. In the case wherein the lights 532 are designed to operate on the basis of direct current (DC) electrical power, the transformer 902 may transform alternating current power received from the electrical power receptacle to DC electrical power suitable for operating the lights 532. Instead of using the transformer 902 plugged into to an electrical power receptacle, the ring assembly 100 may receive DC electrical power from a battery pack. The battery pack may be arranged to house a rechargeable cell or accept one or more disposable batteries.

Figure 10:
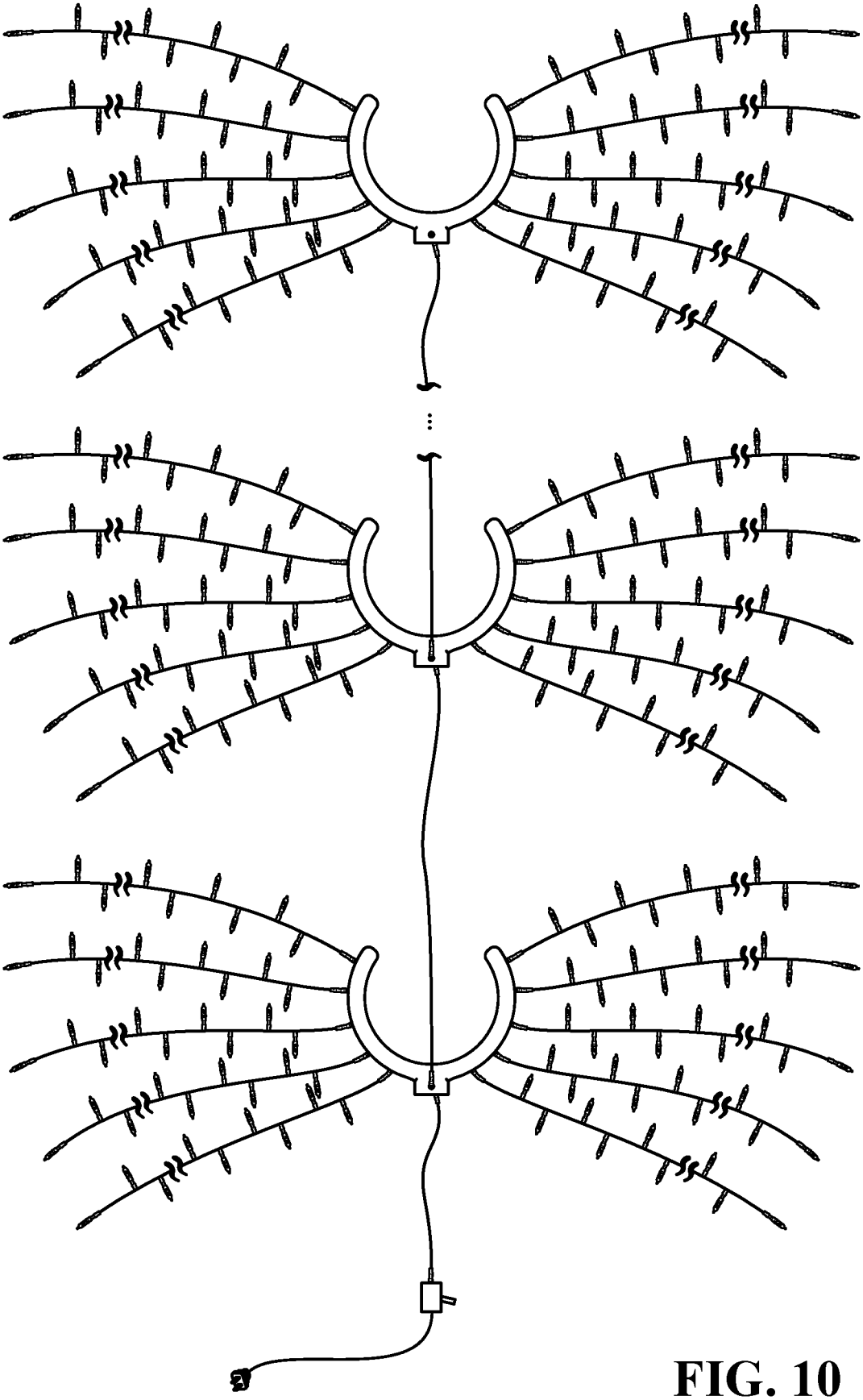
FIG. 10 illustrates the modular tree light system of FIG. 9 in the absence of the tree, according to aspects of the present application.

FIG. 9 illustrates a tree (in stippled lines) on which is installed a modular tree light system including multiple instances of the ring assembly 100 of FIG. 1. FIG. 10 illustrates the modular tree light system of FIG. 9 in the absence of the tree.

Figure 11:
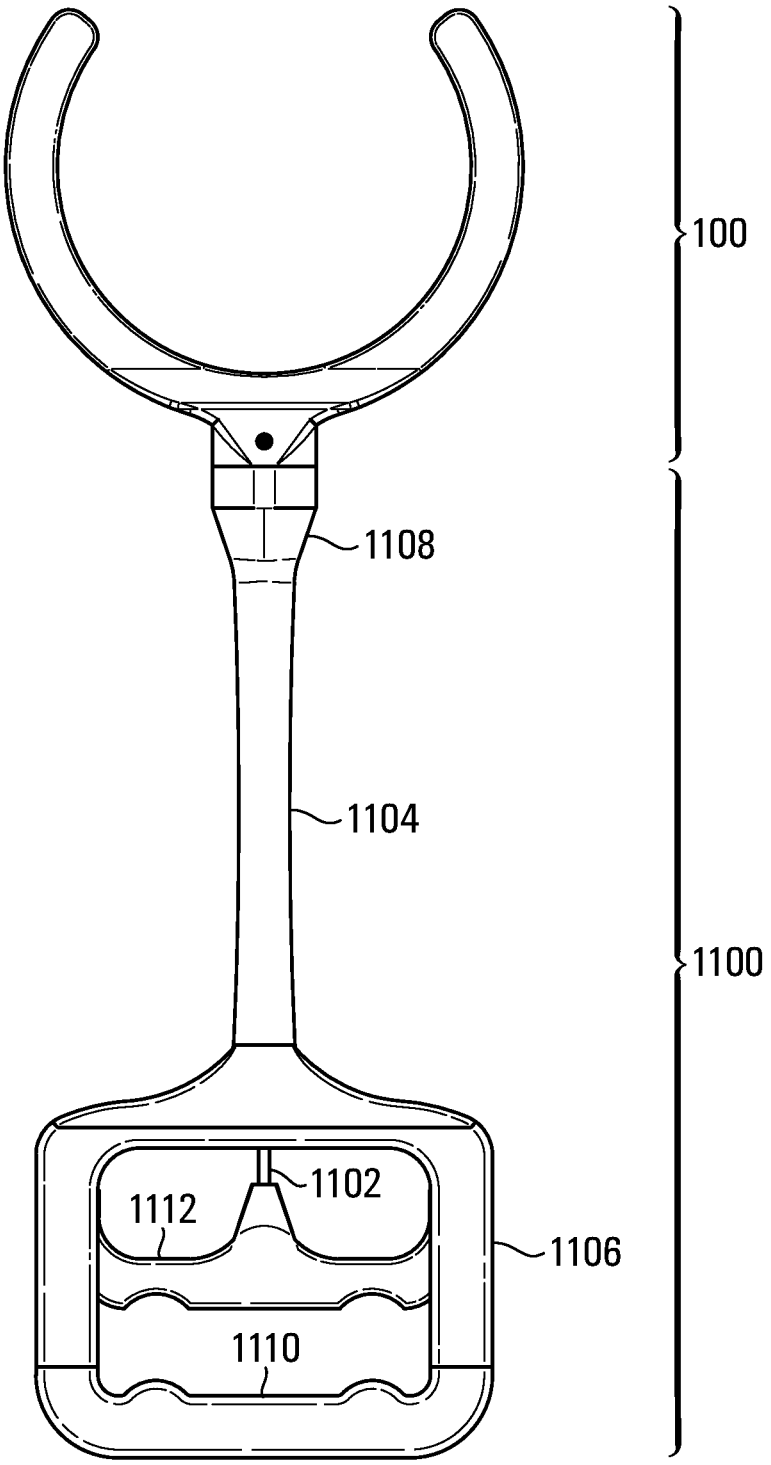
FIG. 11 illustrates a grip assembly to assist in the installation of the ring assembly of FIG. 1 on the tree of FIG. 9, according to aspects of the present application.

FIG. 11 illustrates a grip assembly 1100 attached to the ring assembly 100.

The grip assembly 1100 includes an internal shaft 1102 and an external shaft 1104. The external shaft 1104 defines a channel through which the internal shaft 1102 may travel. At the end of external shaft 1104 that is arranged to be proximate to the ring assembly 100, the external shaft broadens out to define a shaft neck 1108. A handle 1106 is defined at the end of external shaft 1104 that is arranged to be distal from the ring assembly 100. The handle 1106 defines an aperture in which a grip 1112 may slide toward and away from an internal surface 1110 of the handle 1106. The grip 1112 is fastened to distal end of the internal shaft 1102. On the proximate end of the internal shaft 1102, a grip assembly magnet (not shown) is fastened to the internal shaft 1102. The grip assembly magnet is arranged to be a similar size and opposite polarity to the ring assembly magnet 540.

In operation, according to aspects of the present application, the shaft neck 1108 of the grip assembly 1100 may be brought close to the neck portion 310 of the ring assembly 100, with the grip 1112 positioned away from the internal surface 1110, such that the grip assembly magnet and the ring assembly magnet 540 magnetically connect to each other, thereby connecting the grip assembly 1100 to the ring assembly 100. A user may then use the grip assembly 1100 to position the ring assembly 100 around the trunk of a tree and resting among the branches of the tree. The user may then squeeze such that the grip 1112 is drawn closer to the internal surface 1110 and the grip assembly magnet, on the end of the internal shaft 1102 is drawn back within the shaft neck 1108, thereby causing the grip assembly magnet and the ring assembly magnet 540 to disconnect. The user may then draw the grip assembly 1100 out from among the branches, thereby leaving the ring assembly 100 in position.

One feature of aspects of the present application that distinguishes the ring assembly 100 from known tree lighting assemblies is the removability of the individual light strands 530. Conveniently, the ring assembly 100 has enough lighting connector jacks 604 to support ten light strands 530. Notably, the ring assembly 100 should not be considered to be limited to ten lighting connector jacks 604. Indeed, the ring assembly 100 may support one lighting connector jack 604 all the way through many more than ten lighting connector jacks 604. Each light strand 530 may be customized to include lights of specific size, shape, wattage and color. That is, one light strand 530 may have lights 532 implemented as white LEDs, another light strand 530 may have lights 532 implemented as green LEDs and a further light strand 530 may have lights 532 implemented as red LEDs. Additionally, it is contemplated that the lights 532 of a particular light strand 530 may have translucent covers in specific shapes, such as tree shapes, star shapes or stocking shapes.

Notably, when the lights 532 are connected in parallel, an electrical problem, such as a short, within is easily fixed by unplugging the affected light strand 530 and plugging in a replacement light strand 530.

Beneficially, installing the first of many connected ring assemblies 100 at the bottom of a tree allows for a shorter distance to be covered by the power cord 536 from ring assembly 100 to electrical power receptacle.

Although a combination of features is shown in the illustrated embodiments, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

Although this disclosure has been described with reference to illustrative embodiments, this description is not intended to be construed in a limiting sense. Various modifications and combinations of the illustrative embodiments, as well as other embodiments of the disclosure, will be apparent to persons skilled in the art upon reference to the description. It is therefore intended that the appended claims encompass any such modifications or embodiments.

What is claimed is:

1. A ring assembly comprising:

a body shaped to fit incompletely around a tree trunk, the body defining a plurality of apertures;

a power connector jack accessible through a first aperture among the plurality of apertures and configured to mate with a power connector plug, the power connector plug connectable to a source of direct current electrical power;

a lighting connector jack accessible through a second aperture among the plurality of apertures and configured for providing the electrical power received at the power connector jack to a strand of parallel-connected lamp elements, the strand connected to a lighting connector plug configured to mate with the lighting connector jack to receive the electrical power; and an electricity conductor installed within the body to connect the power connector jack to the lighting connector jack.

2. The ring assembly of claim 1, further comprising a plurality of additional lighting connector jacks accessible through respective additional apertures among the plurality of apertures and configured for providing the electrical power received at the power connector jack to a additional plurality of strands of parallel-connected lamp elements, each additional strand among the additional plurality of strands connected to an additional lighting connector plug configured to mate with a respective one of the plurality of additional lighting connector jacks to receive the electrical power.

3. The ring assembly of claim 2, wherein the body is generally C-shaped.

4. The ring assembly of claim 3, wherein the plurality of additional lighting connector jacks are positioned around a periphery of the body.

5. The ring assembly of claim 1, wherein the body includes a neck portion extending away from the body.

6. The ring assembly of claim 5, wherein the power connector jack is located in the neck portion.

7. The ring assembly of claim 6, wherein the power connector jack is a primary power connector jack and the ring assembly further comprises a secondary power connector jack accessible through a third aperture among the plurality of apertures and configured to mate with a secondary power connector plug, the secondary power connector plug configured for providing the electrical power received at the primary power connector jack to an additional ring assembly.

8. A tree lighting system comprising:

a source of direct current electrical power;

a power connector plug connectable to the source of direct current electrical power;

a strand of parallel-connected lamp elements, the strand connected to a lighting connector plug;

a body shaped to fit incompletely around a tree trunk, the body defining a plurality of apertures;

a power connector jack accessible through a first aperture among the plurality of apertures and configured to mate with the power connector plug to receive the electrical power;

a lighting connector jack accessible through a second aperture among the plurality of apertures and configured for providing the electrical power received at the power connector jack to the lighting connector; and an electricity conductor installed within the body to connect the power connector jack to the lighting connector jack.

* * * * *